United States Patent [19]

Schramm, II

[11] Patent Number: 4,461,196

[45] Date of Patent: Jul. 24, 1984

[54] MITRE BOX SYSTEM FOR CUTTING COMPOUND ANGLES

[76] Inventor: William M. Schramm, II, 373 Mountain Rd., Pasadena, Md. 21122

[21] Appl. No.: 428,135

[22] Filed: Sep. 29, 1982

[51] Int. Cl.[3] ..... B27G 5/02

[52] U.S. Cl. ..... 83/13; 83/522; 83/581; 83/766

[58] Field of Search ..... 83/761–767, 83/581, 13, 522; 269/295, 288, 87.2

[56] References Cited

U.S. PATENT DOCUMENTS

| | | | |
|---|---|---|---|
| 104,975 | 7/1870 | McAllaster | 83/767 |
| 184,725 | 11/1876 | Putnam | 83/760 |
| 469,159 | 2/1892 | Maroske | 83/763 |
| 680,021 | 8/1901 | Chandler | 83/765 X |
| 831,940 | 9/1906 | Dorn | 83/765 |
| 976,296 | 11/1910 | Robbins | 83/766 X |
| 2,205,095 | 6/1940 | Jacobsen | 83/766 |

*Primary Examiner*—James M. Meister
*Attorney, Agent, or Firm*—John F. McClellan, Sr.

[57] ABSTRACT

A mitre box system for cutting 90° wall intersection compound angles on interior molding and similar trim without need to know the angle to be cut either before or after cutting, includes a base with upright slotted sides therealong and a rising bed pivotal upward about an end of the mitre box from a position parallel with the base to a position indicated by a linear scale on the end of the mitre box as being equal to a measured linear distance from the end of a level of length equal to the rising bed to a ceiling, one end of the level being for the measurement at the corner requiring the compound angle; each end of the mitre box has similar provisions and the base extends out at either end for clamping.

2 Claims, 3 Drawing Figures

MITRE BOX SYSTEM FOR CUTTING COMPOUND ANGLES

FIELD OF THE INVENTION

This invention relates generally to carpentry and specifically to a mitre box system for cutting compound angles accurately without need to make any angle measurement.

SUMMARY OF THE INVENTION

Cutting compound angles for interior trim such as molding requires accurate, precise cuts to avoid spoiled work and poor appearance.

Metallic devices for laying out and cutting compound angles have been known but are generally too heavy, too expensive or too hard to use to have become standard item of commerce for the purpose.

A principal object of this invention is to provide a mitre box system for use in cutting 90°-wall compound angles without ever knowing the angles.

Further objects are to provide a mitre box system as described in which the only measurements that need to be made are straight-line rule measurements, and the only manipulation of the work is to hold it in the intended location, for marking, and then to hold it on a rising bed in the mitre box for sawing, followed by nailing it in place.

Yet further objects are to provide an accurate, foolproof mitre box system which is fast and easy to use, costs very little, is lightweight but durable, requires little adjustment, an be made in any desired size, can be clamped on a bench or sawhorse, and is safe in operation.

BRIEF DESCRIPTION OF THE DRAWINGS

The above and other objects and advantages of the invention will become more readily apparent on examination of the drawings, in which like reference numerals refer to like parts.

DETAILED DESCRIPTION

Figure 1:
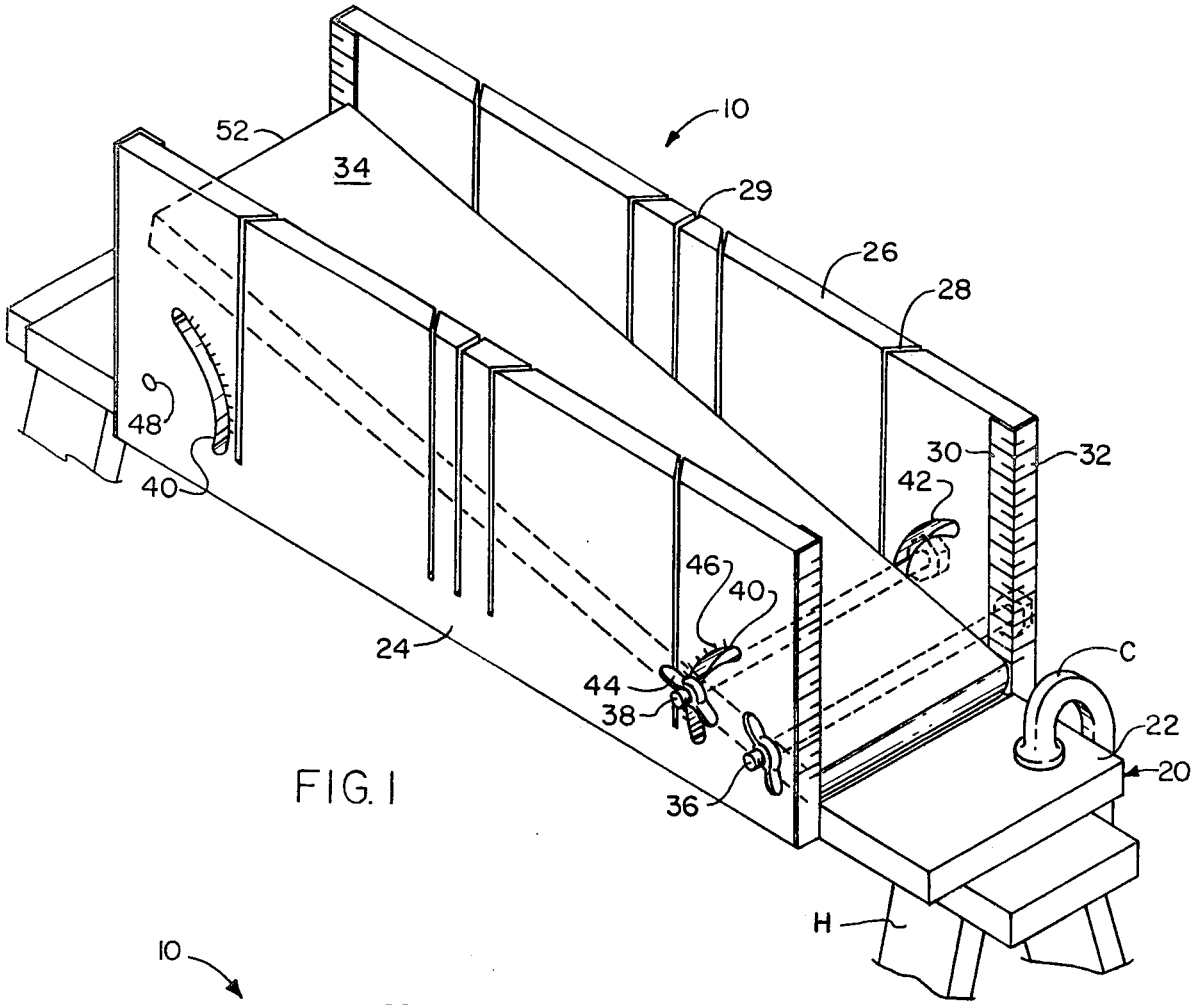
FIG. 1 is an isometric view of a mitre box according to the system of this invention.
Figure 2:
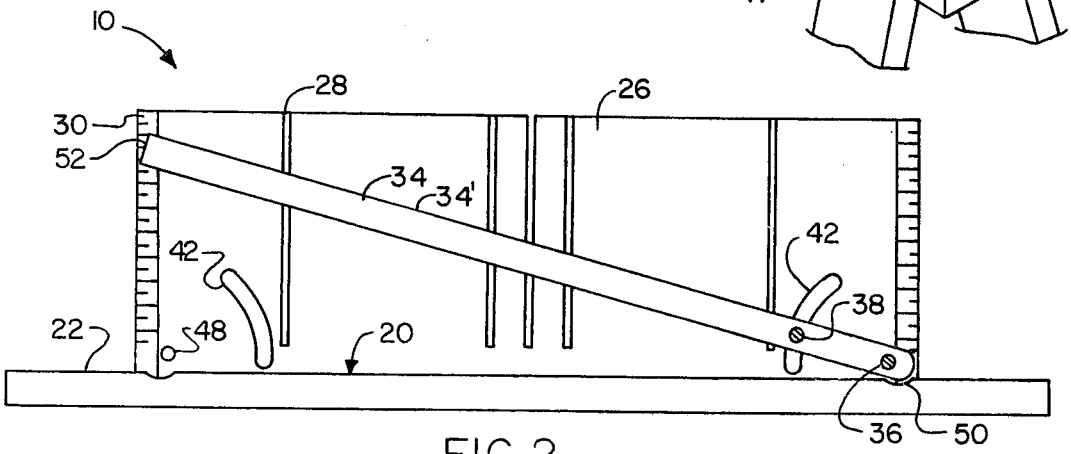
FIG. 2 is a side elevational detail thereof with the near side removed for exposition.

FIGS. 1 and 2 show the invention in embodiment 10. It includes a base 20 which may extend at the ends as at 22, for clamping to a sawhorse H or a table by means of "C" clamps C.

Upright sides 24, 26 extend along the sides of the base in parallel spacing. Each side has a set of slots 28 at 45° in cross-alignment at each end, and a 90° slot 29.

An upright linear scale 30 which may be in inches and fractions extends along one upright edge of a side at each end of the mitre box, and preferably there is a scale at each end of each side. The scales may be on the inner face of the side as at 30 or on the end as at 32, or both.

A rising bed 34 between the sides and co-extensive with them is pivotal upward about a bolt 36 through the sides 24, 26 and through an end of the rising bed from a position adjacently parallel to the horizontal base 20 to a selected position measurable at an appropriate linear scale 30 at the free end of the rising bed. The rising bed 34 may be fixed in this position by a second bolt 38 through it and through respective arcuate slots 40, 42 in the sides. A wing nut 44 may be used for convenient tightening of the rising bed position, and an arcuate scale 46, may, if desired, be provided, but is not essential.

Preferably, the other ends of the sides also have holes 48 and slots 40 so that the rising bed can be pivoted and fixed there if desired, as an alternative, or two short rising beds can be used together.

The scales 30, 32 begin in the plane of the top surface of the rising bed 34 when it is parallel with the base 20.

Because the rising bed is not pivoted exactly at the rising bed end, but instead about one inch (2.5 cm) from it, to allow room for the pivot, the base 20 may have a clearance 50 formed in it for each end of the rising bed.

Regardless of what system of measurement is used, the overall length of the sides 24, 26 may be about 25 units (for example 25 inches) and the pivot bolt locations 1 unit (for example 1 inch) in from the end of the sides.

Figure 3:
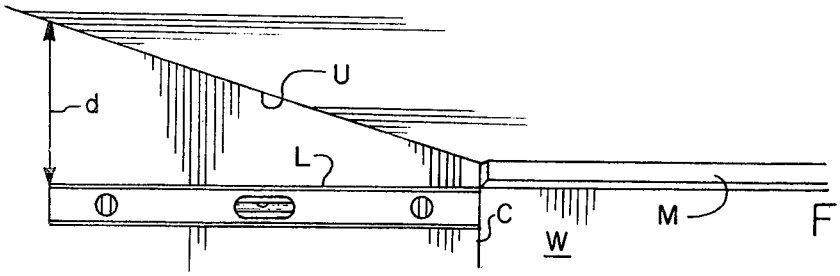
FIG. 3 is a fragmentary perspective view of a measurement being taken at a corner of a room according to the system of this invention.

The next Figure shows the reason for these proportions. FIG. 3 shows that to use the system the user employs a conventional carpenter's level L, the same length as the rising bed from pivot bolt 36 to free end 52; namely preferably 24 inches (62 cm) long. This proportion should be kept in any size embodiment.

A typical 90° corner C is shown with a level molding M and an upslant U requiring molding joining it at a compound angle at a corner. Molding M is first cut with conventional 45° ends and nailed in place.

Next the level is placed under the upslant U with the first end of the level against the wall W beneath the level molding M, and the vertical linear distance d between the second end of the level and the upslant is measured.

The distance measurement is then used to set the angle of the rising-bed 34. Because the scales 30, 32 begin in the plane of the top surface 34' of the rising bed 34 when it is parallel with base 20, it is a simple matter to raise the free end of the rising bed until the plane of the top intersects the scale at the position equal to the distance measured.

The user then selects the correct-direction 45° slot and places the end of the molding at the desired location in the mitre box and saws it off. Then, for shed-roof type work, the user makes a similar but opposite cut on the far end of the molding at the desired location and nails it up. For special work the user may make a similar measurement for the second end. The extra inch provides length for angle cutting also.

Basic material for the mechanism is preferably wood. The scales may be lengths of ruler.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a mitre box system having a horizontal base with parallel ends and parallel sides, a rising bed on the base, a respective slotted upright fixed along each side of the base, and each upright having 90° and 45° slots aligned with corresponding slots in the other upright, the improvement comprising: said rising bed being between the uprights and having first and second ends and a top surface, a linear scale fixed upright relative to said rising bed at an end of a said upright, means permitting pivoting the rising bed first end upward from a position adjacently parallel with the base to a selected position indicated by said linear scale, means for fixing the rising bed in a said selected position, said means for permitting pivoting located at a second end of said rising bed and joining said rising bed and uprights, and said linear scale having graduations commencing in the plane of the top surface of the rising bed when the rising bed is in said position adjacently parallel with the base.

2. In a mitre box system method for cutting a compound angle on molding for a 90° wall corner with one wall upslant, without angular measurement and layout, the steps comprising:

(a) cutting a 45° angle on an end of a piece of molding;

(b) placing the piece of molding along the top of one wall of the corner with the 45° cutout in the corner;

(c) placing a level of a known length in a level position below said upslant with a first end of the level against said wall in the corner beneath said piece of molding;

(d) measuring the vertical linear distance from the second end of said level to the upslant;

(e) providing a slotted mitre box with pivoted-rising-bed of the same length from pivot to free end as the length of said level, and capable of pivotal adjustment from a position parallel with the mitre box base;

(f) adjusting the rising bed free end top surface a distance from the position of same when parallel with the base, equalling said vertical linear distance; and (g) inserting said molding in the mitre box to an end adjacent said pivot and cutting said compound angle using said slots to guide a cutter, thereby cutting said compound angle.

* * * * *